United States Patent [19]

Krueger

[11] Patent Number: 4,531,875

[45] Date of Patent: Jul. 30, 1985

[54] AUTOMATED PIPE EQUIPMENT SYSTEM

[75] Inventor: Roger J. Krueger, Arvada, Colo.

[73] Assignee: Impro Technologies, Inc., Arvada, Colo.

[21] Appl. No.: 408,795

[22] Filed: Aug. 17, 1982

[51] Int. Cl.[3] ..... E21B 19/14

[52] U.S. Cl. ..... 414/22; 198/488; 221/75; 901/33; 211/70.4

[58] Field of Search ..... 414/22, 745, 748; 198/488; 221/75; 175/52, 85; 211/60 S; 901/33, 35

[56] References Cited

U.S. PATENT DOCUMENTS

| | | | |
|---|---|---|---|
| 2,528,945 | 11/1950 | Carpenter | 221/75 X |
| 2,773,605 | 12/1956 | De Jarnett | 414/22 |
| 3,501,017 | 3/1970 | Johnson et al. | 211/60 S |
| 3,507,405 | 4/1970 | Jones et al. | 414/22 |
| 3,561,811 | 2/1971 | Turner | 294/90 |
| 3,840,128 | 10/1974 | Swoboda, Jr. et al. | 414/22 X |
| 3,844,420 | 10/1974 | Walling et al. | 414/22 X |
| 3,904,234 | 9/1975 | Hill et al. | 414/5 X |
| 3,937,514 | 2/1976 | Langowski | 294/88 |
| 4,042,123 | 8/1977 | Sheldon et al. | 414/22 |
| 4,077,525 | 3/1978 | Callegari et al. | 175/85 X |
| 4,269,554 | 5/1981 | Jackson | 414/22 |
| 4,274,778 | 6/1981 | Putnam et al. | 414/22 |

FOREIGN PATENT DOCUMENTS

| | | | |
|---|---|---|---|
| 766854 | 10/1980 | U.S.S.R. | 901/33 |

OTHER PUBLICATIONS

Roberts, W. F., "Automated Pipe Handling on Floating Drilling Vessels", *Automation in Offshore Oil Field Operation*, pp. 35–40 (1976).

*Primary Examiner*—Leslie J. Paperner

*Attorney, Agent, or Firm*—Sheridan, Ross & McIntosh

[57] ABSTRACT

An automated pipe handling system is provided to increase safety and to minimize the number of workmen required in the coupling and uncoupling of pipe stands. The system includes a programmable controller for monitoring and/or controlling devices which remove and add pipe stands to a drill column. A number of transducers are operatively connected to the controlled devices for communication with the programmable controller for use in verifying that the controlled devices have properly performed their programmed tasks. The controlled devices include upper and lower arm assemblies for use in engaging and moving the uncoupled pipe stands to a storage position. The controlled devices further include a finger board assembly and a set-back assembly. The finger board assembly moves and retains the upper portions of the pipe stands while a drill rig floor of a derrick supports their lower portions. The set-back assembly is used to hold the lower portions of the pipe stands and to move the pipe stands to the predetermined storage positions on the drill rig floor.

11 Claims, 32 Drawing Figures

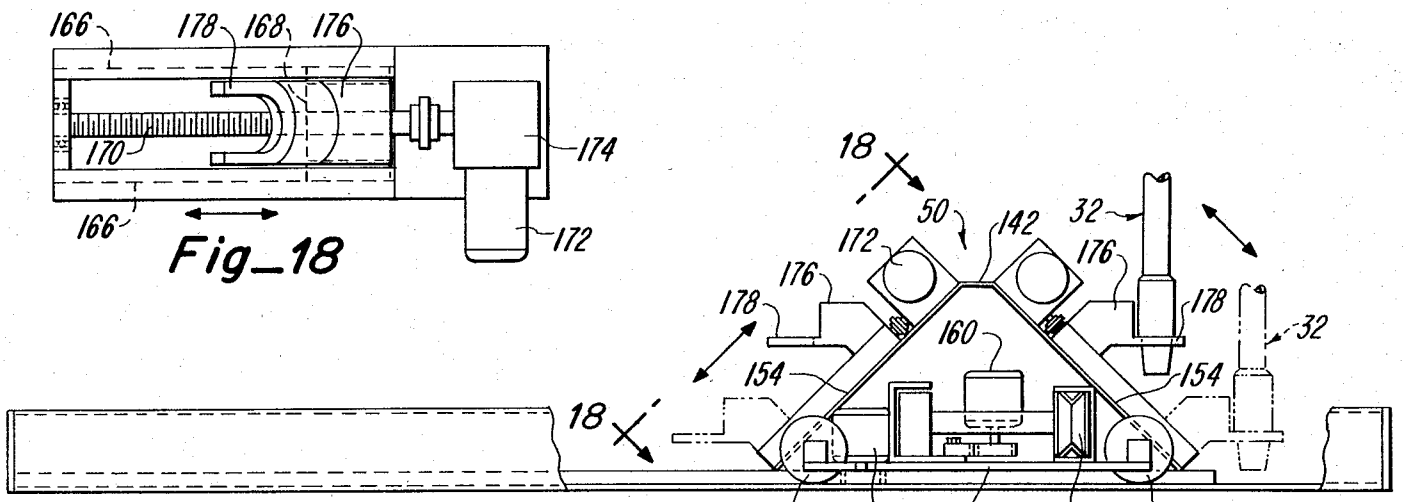
Fig_16
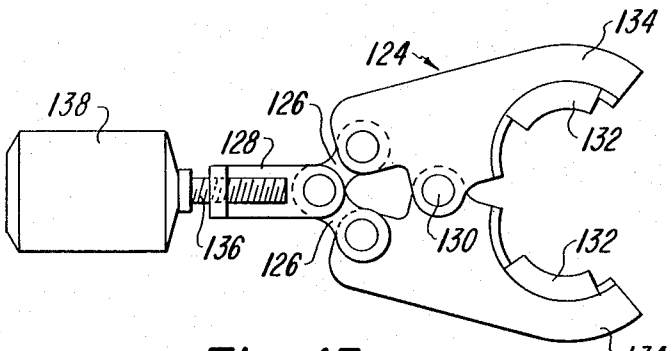
Fig_15
Fig_18
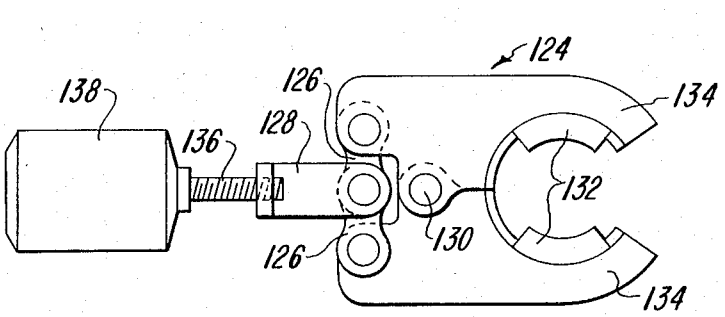
Fig_14

AUTOMATED PIPE EQUIPMENT SYSTEM

FIELD OF THE INVENTION

The present invention relates to an automated system for use in the drilling industry and, in particular, to a system for removing pipe from and providing additional pipe to a drill string, as well as for monitoring desired parameters and conditions associated with the drilling operation.

BACKGROUND ART

In drilling operations, it is common practice to removed thousands of feet of pipe from a well hole in order to replace a worn drill bit. The pipe is uncoupled and stacked as it is removed. In order to reduce the time for accomplishing the repetitive task of uncoupling and storing pipe, automation of various steps involved in the uncoupling process has resulted. Remotely controlled racking arms have been devised for gripping portions of pipes. A power torque winch has come into use for breaking the tight connection between two adjacent sections of pipe rather than applying mechanical wrenches requiring a number of workmen to do the same job. A power spinning wrench has recently come into use for rapidly rotating the pipe to be removed with respect to the drill string so that the pipe can be uncoupled and moved to temporary storage. Finger board sections have been employed on the derrick to receive upper portions of pipe stands to permit vertical storing of the pipe stands. In addition, a computerized system has been proposed which monitors the position of racker arms for grabbing pipes and controls the movement of the racker arms.

Although the foregoing contributions to the task of uncoupling, as well as coupling, pipe stands have improved the efficiency of the drilling operation, some significant deficiencies still remain. None of the prior art systems is fully automated since verification of each step of the system operation is not automatically done before a next step is initiated. In this regard, the present invention utilizes sensing means, such as transducers, for use in indicating to a programmable controller whether a pipe stand has actually been grasped by a racking arm. There is no need for a drill rig operator to check whether this grasping step has occurred since the system itself can make such a determination. In addition, the present invention incorporates newly devised controllable arms and a transport assembly for grabbing and holding pipe stands during the uncoupling and coupling operations. These devices can be used with presently available drilling equipment and are adapted to be readily utilized with and supported by a conventional derrick or drill rig floor.

STATEMENT RELATING TO PRIOR ART

Publication entitled "Automated Pipe Handling On Floating Drill Vessels" from *Automation In OffShore Oil Field Operation* by W. F. Roberts, Jr., J. A. Howard, H. E. Johnson (1976), describes a pipe handling system which utilizes digital computer control. The computer is able to determine the position of controlled devices, such as pipe racking arms, using a servo system. Depending upon the determined positions of such controlled devices, the computer is able to control further operations thereof. However, this proposed system does not include, among other things, verifying means for providing information to the computer as to whether the desired operation was actually performed. In the case of grabbing a pipe stand, even though the computer system monitors the position and movement of the racker arm relative to a pipe stand, it does not have the capability of determining whether the racker arm has, in fact, grasped a pipe stand. The system only knows that the jaws, for example, were activated to grasp a pipe stand, not whether a pipe stand was actually grasped.

U.S. Pat. No. 3,501,017 to Johnson et al. issued Mar. 17, 1970 discloses a pipe racking apparatus including a finger board having horizontally extending fingers and latches for use in holding pipe stands.

U.S. Pat. No. 3,507,405 to Jones et al. issued Apr. 21, 1970 describes a block and hook assembly for movement offset from a center line of a derrick so that the assembly will not interfere with a pipe stand positioned along the center line.

U.S. Pat. No. 3,561,811 to Turner Jr. issued Feb. 9, 1971 relates to a pipe racking system having a number of racker arms controlled from a remote location.

U.S. Pat. No. 3,937,514 to Langowski issued Feb. 10, 1976 provides a pipe guide head having shiftable slide plates for receiving and holding pipe.

U.S. Pat. No. 3,840,128 to Swoboda Jr. et al. issued Oct. 8, 1974 relates to a telescoping pipe racking arm which has lateral, vertical, and rotational movement.

DISCLOSURE OF THE INVENTION

In accordance with the present invention, a system is provided for use in the drilling field for automatically removing stands of pipe and for providing additional stands of pipe for placement below a drill rig floor, such as in a well formed through the earth's surface or the ocean floor. The system also automatically monitors significant parameters and conditions pertinent to the drilling operation. The system includes a programmable controller which is programmed to initiate and control the workings of a number of devices operatively associated with the programmable controller. Power slips are provided for use in supporting pipe stands positioned below the drill rig floor. A pipe elevator is used to engage the upper end of a pipe stand to be uncoupled from other pipe stand(s). An upper arm assembly is provided adjacent to an upper portion of a derrick, which supports the drill rig floor. A lower arm assembly is positioned on the drill rig floor adjacent to the opening through which pipe stands are placed into the well. A finger board assembly is also supported at the upper portion of the derrick for cooperation with the upper arm assembly. A set-back assembly is also located on the drill rig floor adjacent to the pipe stands. The controlled devices further include a power tong and a power spinner supported on the drill rig floor. In one embodiment, the power tong and the power spinner are incorporated into a single unit.

The controlled devices cooperate to remove stands of pipe which are presently positioned below the drill rig floor or, alternatively, to provide additional stands of pipe to the drill string. In removing pipe stands, the pipe elevator engages an upper portion of a pipe stand and the pipe stand is raised to a predetermined height above the drill rig floor so that the upper arm assembly can be extended to engage an upper portion of the pipe stand to thereby assist in the supporting of the pipe stand. In addition, the power slips are activated to support the pipe stands remaining below the drill rig floor. After the remaining pipe stands are supported and the upper portion of the pipe stand to be uncoupled or removed is held by the upper arm assembly, the power tong is moved to engage the pipe stand lower portion for the purpose of initially breaking the tight coupling between the raised pipe stand and the remaining pipe stands. The power spinner is used to completely uncouple the raised pipe stand from the remaining pipe stands. With regard to the uncoupling operation, the lower arm assembly is used to loosely engage the pipe stand before the pipe stand is uncoupled. After the pipe stand is uncoupled or spun loose, the lower arm assembly is raised upwardly to provide a firm grip about the lower portion of the uncoupled pipe stand. In conjunction with the upper arm assembly, the lower arm assembly next moves the uncoupled pipe stand to the set-back assembly so that, during this movement, the uncoupled pipe stand remains substantially vertical. Upon reaching the set-back assembly and with the pipe stand held by the set-back assembly, the lower arm assembly is lowered to disengage the pipe stand and then the grip of the lower arm assembly is released. The set-back assembly and upper arm assembly cooperate to move the uncoupled pipe stand in a first direction to a predetermined position relative to the drill rig floor. After reaching that position, the set-back assembly typically moves the lower portion of the pipe stand in a second direction to a predetermined position at which the pipe stand is to be stored on the drill rig floor. Before the set-back assembly moves the pipe stand lower portion in the second direction, the upper portion of the removed pipe stand is released by the upper arm assembly to the finger board assembly, which securely holds this upper portion. In accomplishing each of the steps associated with grasping and moving pipe stands, the programmable controller is provided with information using transducers, coupled to the controlled devices, regarding whether each step was actually taken before the programmable controller continues with the initiating of the next step.

For removal of additional pipe stands, the foregoing process is followed with next-to-be-stored upper portions of pipe stands being placed into the finger board assembly while previously stored upper portions of pipe stands are moved to provide space in the finger board assembly for these subsequently removed pipe stands.

In one embodiment, in order to couple additional pipe stands to the drill string, the foregoing process is essentially reversed, with the last pipe stand positioned in the finger board assembly being the first pipe stand to be selected for coupling the placement below the drill rig floor.

In view of the foregoing description, it is seen that a number of worthwhile advantages of the present invention are achieved. A system is provided for automatically removing pipe stands from and adding pipe stands to a drill string. The automated system significantly minimizes the number of workmen required in the removal and addition of pipe stands. Specifically, because of the automatic features provided, workmen are not needed to secure a pipe elevator to a pipe stand to be coupled or uncoupled to a drill string; workmen need not position the power tong and power spinner for uncoupling or coupling pipe stands; workmen are not required to activate the power slips for supporting the remaining drill string; workmen are not needed to move the upper portions of pipe stands from the pipe elevator to the finger board assembly; workmen are not needed to move the lower portion of the pipe stand between the drill rig floor on which pipe stands are stored and the opening in the drill rig floor through which the remaining pipe stands are placed into a well. Concomitantly, since workmen are not needed to perform these tasks, the present system greatly reduces the possibility of serious human injury which can occur during the foregoing described operation of removing and adding pipe stands.

BRIEF DESCRIPTION OF THE DRAWINGS

FIG. 14 is a top plan view of the jaws of the lower arm assembly in a closed position;

FIG. 15 is a top plan view of the jaws of the lower arm assembly in an opened position;

FIG. 16 is a front elevational view of the set-back assembly showing movement of the two cups and wherein one cup is shown supporting a pipe stand;

FIG. 18 is an enlarged view showing a track along which a cup is moved;

DESCRIPTION OF THE PREFERRED EMBODIMENTS

Figure 1:
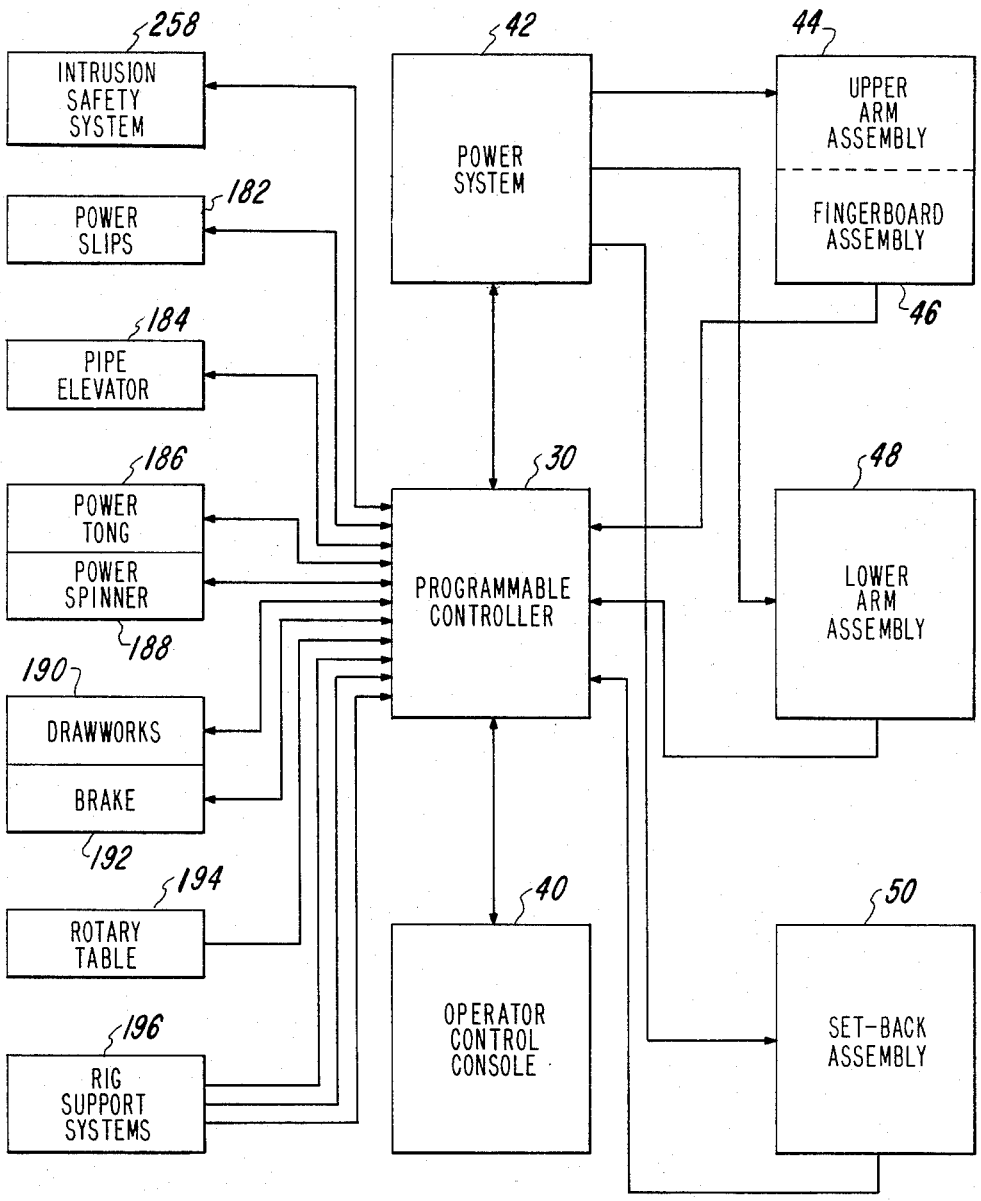
FIG. 1 is a block diagram of the automated drilling system of the present invention.

In accordance with the present invention, an automated system for use in the drilling industry is illustrated in block form in FIG. 1. The system includes a programmable controller 30 for controlling devices which are used in uncoupling or removing and coupling or adding pipe stands 32, as illustrated in FIGS. 2A–2C through 7A–7C. Each pipe stand 32 typically includes more than one pipe section 34. Pipe sections 34 are normally threadedly coupled together to form each of the pipe stands 32. After pipe stands 32 are coupled together, they are positioned through an opening formed in the drill rig floor 36. This opening is typically aligned with a well formed in the earth or a well formed through the ocean floor. In a typical operation, the length of the interconnected pipe stands 32 exceeds thousands of feet and a drill bit is joined adjacent to the lowermost pipe stand 32 for drilling the surrounding ground formation. The drill rig floor 36 is supported by a conventional derrick 38.

The programmable controller 30 is a commercially available unit, such as a Gould-Modicon programmable controller. In the present invention, the programmable controller includes the appropriate software for controlling the devices relating to the removal and addition of pipe stands 32 from and to the well which is located below the drill rig floor 36.

An operator control console 40, as represented in FIG. 1, interfaces with the programmable controller 30 and is used to provide desired inputs by means of operator selection to the programmable controller 30, such as initiating the automatic sequencing of pipe stand 32 coupling. The operator control console 40 also includes visual display of certain parameters and conditions monitored by the programmable controller 30, such as the operating states of the controlled devices.

Figure 8:
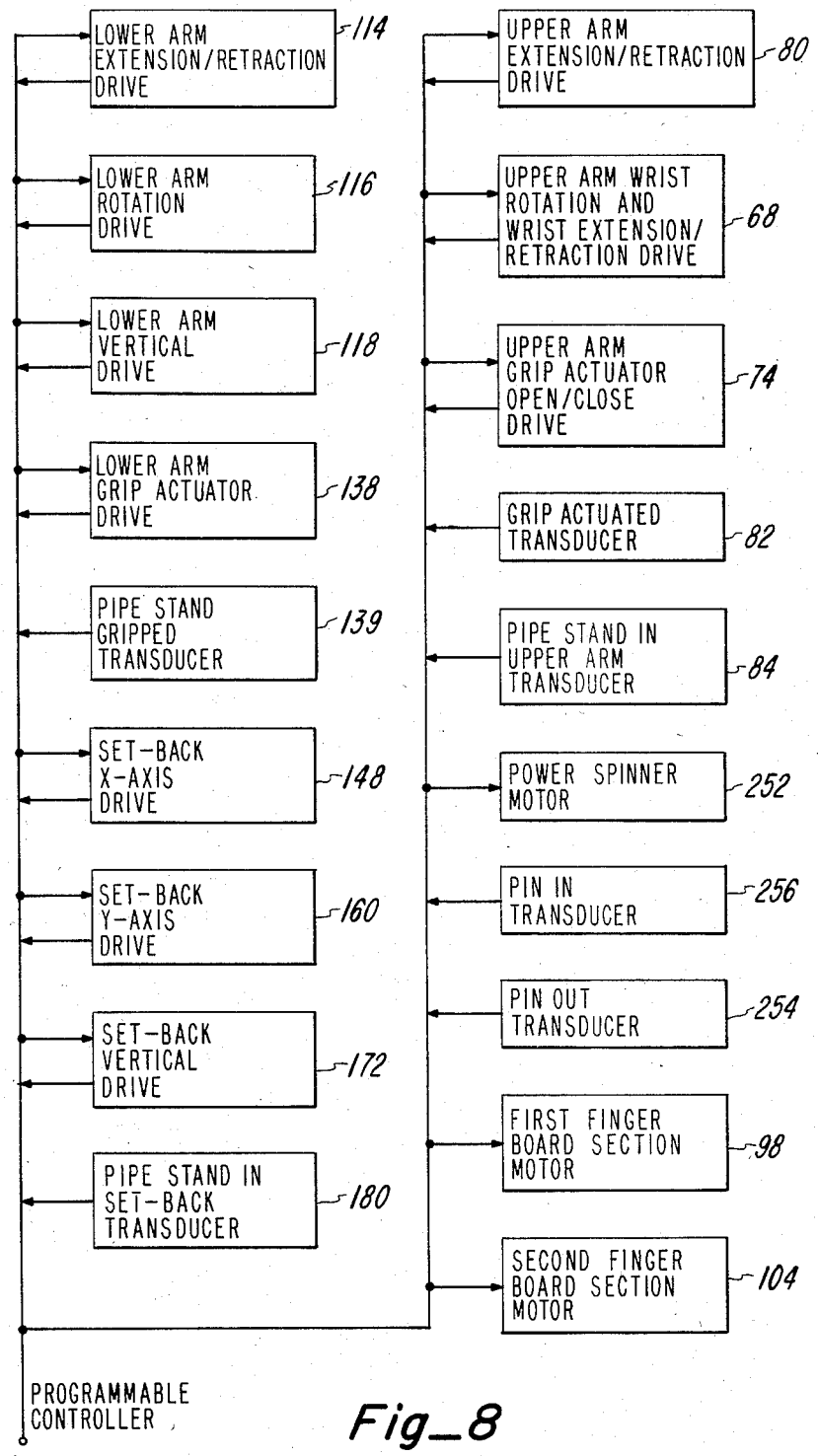
FIG. 8 is a block diagram of the servormotor drives of the present invention.

A power system 42 also communicates with the programmable controller 30 and includes a number of servomotor drives actuatable by means of control signals from the programmable controller 30. Servomotor drives used in the present invention are represented in FIG. 8, which also outlines the functions of the servomotor drives. These functional features will be described subsequently in greater detail. Each servomotor drive provides active feedback to the programmable controller 30 so that the programmable controller 30 continuously receives data information from the servomotor drives relating to the position of the particular device which the servomotor drive powers. Conventional servomotor drives can be utilized, such as are available from Gould-Gettys of Racine, Wis.

The power system 42 communicates with a number of newly devised controlled devices including an upper arm assembly 44, a finger board assembly 46, a lower arm assembly 48, and a set-back assembly 50.

Figure 9:
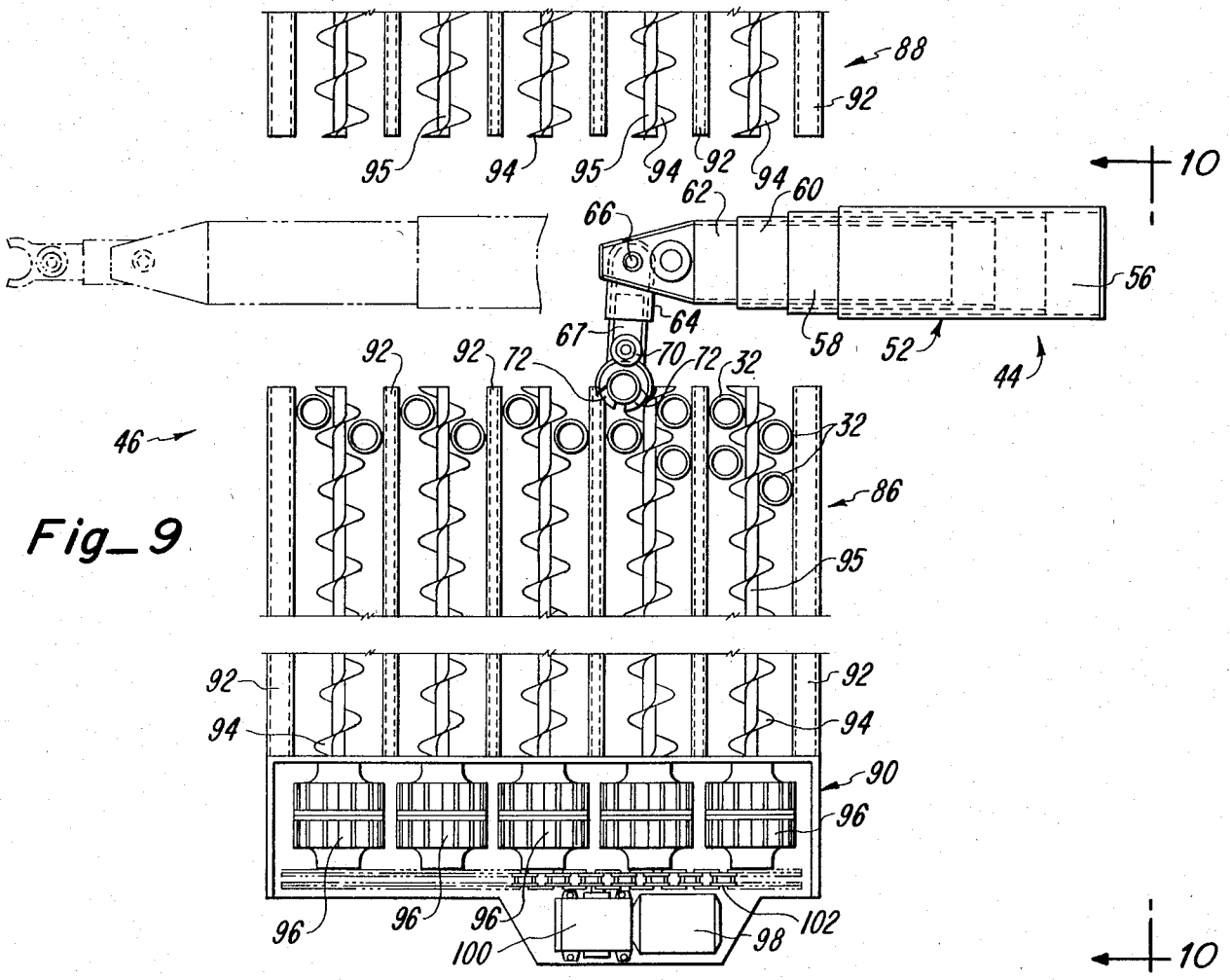
FIG. 9 is a top plan view of portions of the finger board assembly.
Figure 10:
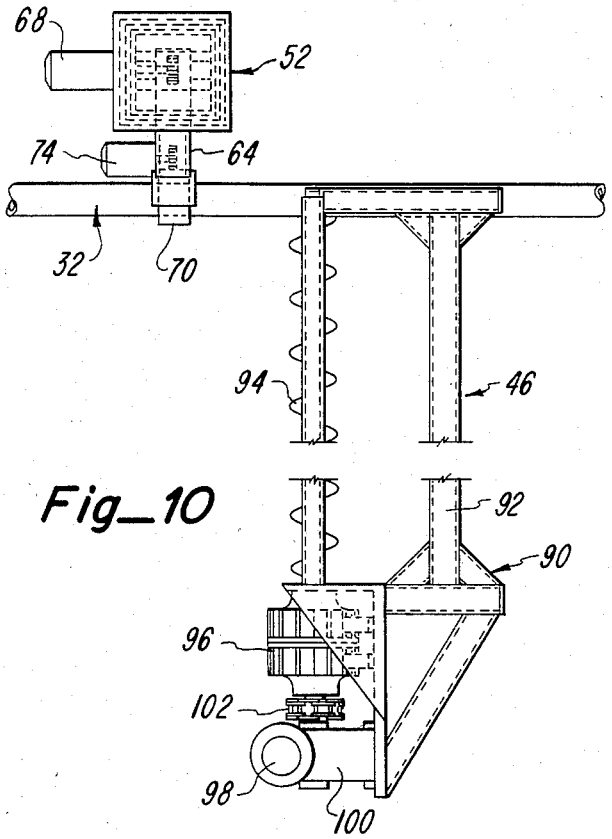
FIG. 10 is an elevational view of portions of the finger board assembly.
Figure 11:
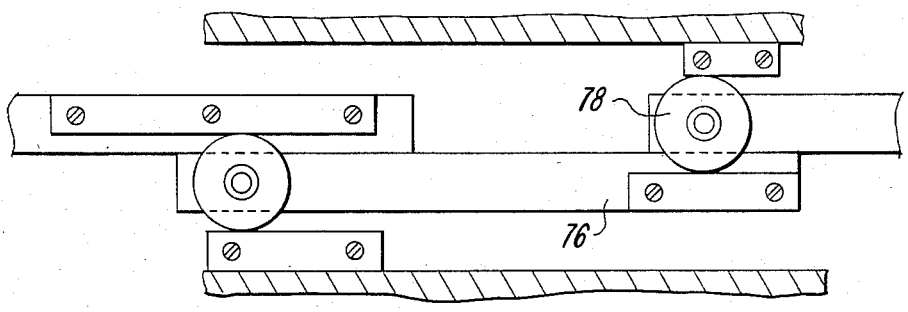
FIG. 11 is a schematic representation of a rack and pinion arrangement used for extending portions of the upper arm assembly.

With reference to FIGS. 9, 10, and 11, the upper arm assembly 44 includes a telescoping upper arm 52 having a main body 56, a first extendable portion 58, a second extendable portion 60, and a third extendable portion 62. A wrist 64 is joined to the end of the third extendable portion 62 by means of pivot pin 66 and includes an extendable wrist portion 67. The power for both the extension/retraction of extendable wrist portion 67 and the rotational movement of the wrist 64 is provided by a single servomotor drive 68, which is also represented in FIG. 8. In this regard, the output shaft of servomotor drive 68 rotates first to pivot the wrist 64 about pivot pin 66 and then continued rotation of the output shaft of servomotor drive 68 results in an extension of the extendable wrist portion 67.

A clamp 70 is pivotally joined to the free end of the extendable wrist portion 67. Opening and closing of jaws 72 of the clamp 70 are provided using the servomotor drive 74, which is also represented in FIG. 8. The jaws 72 are able to loosely engage the pipe stand 32 to permit vertical and rotational movement of the engaged pipe stand 32. Extension and retraction of each of the extendable portions 58, 60, 62 of upper arm 52 is provided using a rack 76 and pinion 78 arrangement driven by a servomotor drive 80, which is represented in FIG. 8.

The upper arm assembly 44 also includes a pair of transducers 82, 84, as represented in FIG. 8. Transducer 82 communicates with the programmable controller 30 and senses whether the clamp jaws 72 have been actuated to open or close. Transducer 84 also communicates with the programmable controller 30 and monitors whether a pipe stand 32 has been firmly grasped by the clamp jaws 72 so that the pipe stand 32 can be moved using the upper arm assembly 44. Unless a signal is received from transducer 84 indicating that the pipe stand 32 is held by the upper arm assembly 44, the programmable controller 30 will not initiate movement of the upper arm assembly 44 in order to transport the pipe stand 32 to a desired location.

Also referring to FIGS. 9 and 10, as well as the schematic representations depicted in FIGS. 2A–2C through 7A–7C, details of the finger board assembly 46 are described. In the preferred embodiment, the finger board assembly 46 includes a first finger board section 86 and a second finger board section 88. The two finger board sections 86, 88 are separated so that a space is provided for movement of the upper arm assembly 44 therebetween. Each finger board section 86, 88 includes the same structural elements including a frame 90 having a number of supports 92 connected to the frame 90. Each frame 90 is supported relatively adjacent to the center or midportion of the derrick 38 and extends partially, laterally across the derrick 38. A screw conveyor 94 is held between each of the supports 92 and extends throughout the length of the supports 92. Each screw conveyor includes a plurality of helicoidal surfaces 95. A clutch brake 96 is operatively connected to each of the screw conveyors 94. A predetermined clutch brake 95 is selectable for use in driving a desired screw conveyor 94. With respect to the first finger board section 86, the energization of motor drive 98 is controlled by the programmable controller 30 and the motor drive 98 is used to provide power to the selected screw conveyor using the clutch brake 96 which has been activated by the programmable controller 30. The input to the clutch brakes 96 from the motor drive 98 is coupled through a reduction gear 100 and a chain and sprocket drive 102. With respect to the second finger board section 88, and in a similar manner, a motor drive 104 is energized to drive the selected screw conveyor 94. Both the first finger board section motor drive 98 and the second finger board section motor drive 104 are schematically represented in FIG. 8. It is understood that, although each finger board section 86, 88 is shown including five screw conveyors 94, any different number of screw conveyors 94 could be utilized and controlled by means of the programmable controller 30.

The lower arm assembly 48 is shown in detail in FIGS. 12–15 and is also schematically represented in FIGS. 2A–2C through 7A–7C. The lower arm assembly 48 includes a base 106 supported on the drill rig floor 36. A connecting member 108 interconnects the base 106 and a telescoping lower arm 110 having an extendable portion 112. A servomotor drive 114 is used to extend and retract the extendable arm portion 112. The servomotor drive 114 is operatively coupled to a screw threaded member 115 to threadedly move the threaded member 115 relative to a drive nut 117, which is connected to an end of the extendable portion 112. The lower arm 110 is also rotatable in a horizontal plane, the lower arm 110 being driven by a servomotor drive 116. The servomotor drive 116 is coupled to a reduction gear 119 which is used to operate a spur gear 121. The spur gear 121 operatively engages another spur gear 123, which is operatively joined to the connecting member 108. The lower arm 110 is also movable in a vertical plane using a servomotor drive 118. The output of servomotor drive 118 is coupled to a reduction gear 120. The reduction gear 120 is used to operate a drive nut (not shown) which engages a screw threaded member 122 carried by the connecting member 108 to raise and lower the lower arm 110.

Figure 13:
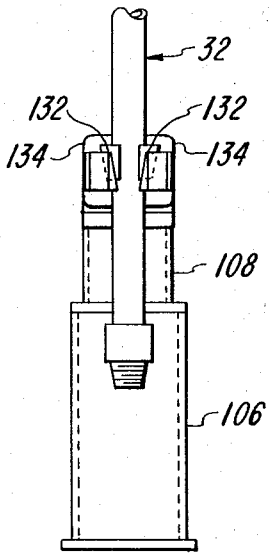
FIG. 13 is a front elevational view of the lower arm assembly grasping a pipe stand.
Figure 12:
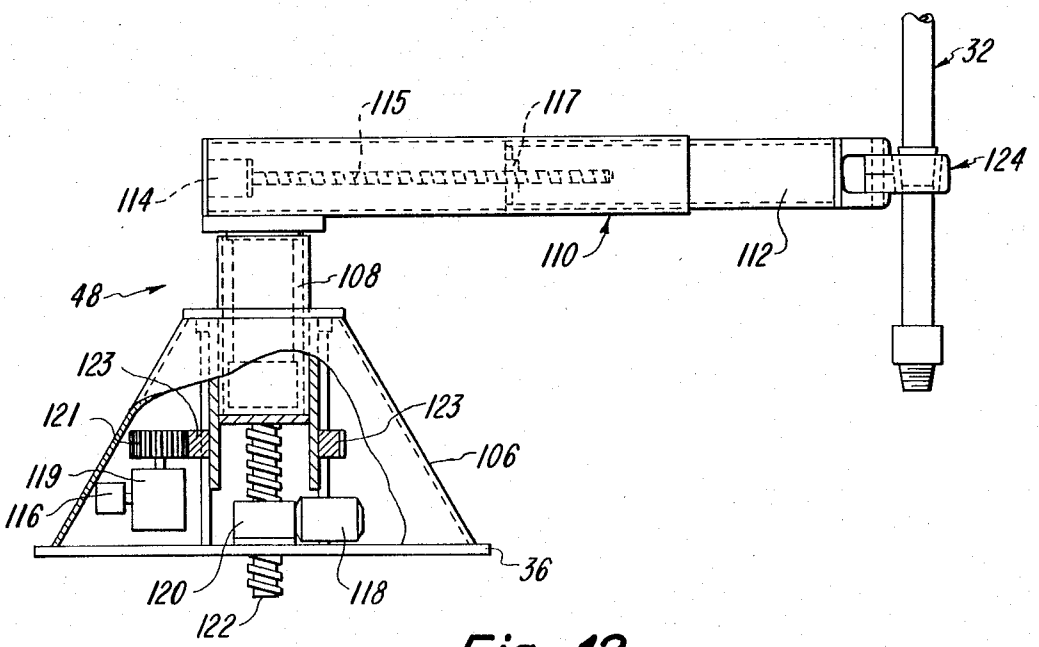
FIG. 12 is a side elevational view of the lower arm assembly grasping a pipe stand.

A clamp assembly 124 is attached to the free end of the lower arm extendable portion 112. The clamp assembly 124 includes toggle joints 126, as best seen in FIGS. 14 and 15. The clamp assembly 124 further includes a link member 128, a pivot member 130, and a pair of jaw slips 132 mounted on a pair of jaws 134. One end of the link member 128 is operatively joined to the free end of a threaded shaft 136 which is driven by a servomotor drive 138, also represented schematically in FIG. 8. The opposite end of the link member 128 is operatively connected to the toggle joints 126. When the link member 128 is driven by the servomotor drive 138 to the right (with reference to FIG. 14) relative to the servomotor drive 138, the jaws 134 pivot about pivot member 130 and begin to assume a closed position for grasping a pipe stand 32. The jaws 134 are able to loosely hold the lower portion of the pipe stand 32, during the tightening or loosening of a pipe stand 32 to or from another pipe stand 32, in order to permit rotational movement of the pipe stand 32. However, in order to move an uncoupled pipe stand 32, the jaws 34 must firmly grasp the uncoupled pipe stand 32. To accomplish this requirement, the jaw slips 132 are activated to fixedly hold the pipe stand 32. The jaw slips 132 are so activated by moving the lower arm 110 in an upward direction relative to the uncoupled pipe stand 32. This upward movement of the lower arm 110 causes the jaw slips 132 to wedge in against the lower portion of the uncoupled pipe stand 32 and firmly engage the same, as seen in FIG. 13. Correspondingly, the engagement by the jaw slips 132 of the uncoupled pipe stand 32 can also be provided by a downward movement of the pipe stand 32 relative to the jaw slips 132. Conversely, disengagement of the jaw slips 132 from the pipe stand 32 is provided by a relative downward movement of the lower arm 110 or a relative upward movement of the pipe stand 32.

When the link member 128 is driven by the servomotor drive 138 to the left (with reference to FIG. 15) relative to the servomotor drive 138, the jaws 134 and jaw slips 132 assume an opened position so that a pipe stand 32 held thereby is released.

The lower arm assembly 48 also includes a transducer 139, represented in FIG. 8. The transducer 139 monitors whether the lower arm assembly 48 and, in particular, jaw slips 132 have firmly engaged the lower portion of an uncoupled pipe stand 32. Prior to initiating movement of the uncoupled pipe stand 32, the programmable controller 30 requires that the transducer 139 provide a signal indicating that the lower portion of the pipe stand is securely held by the lower arm assembly 48.

Figure 17:
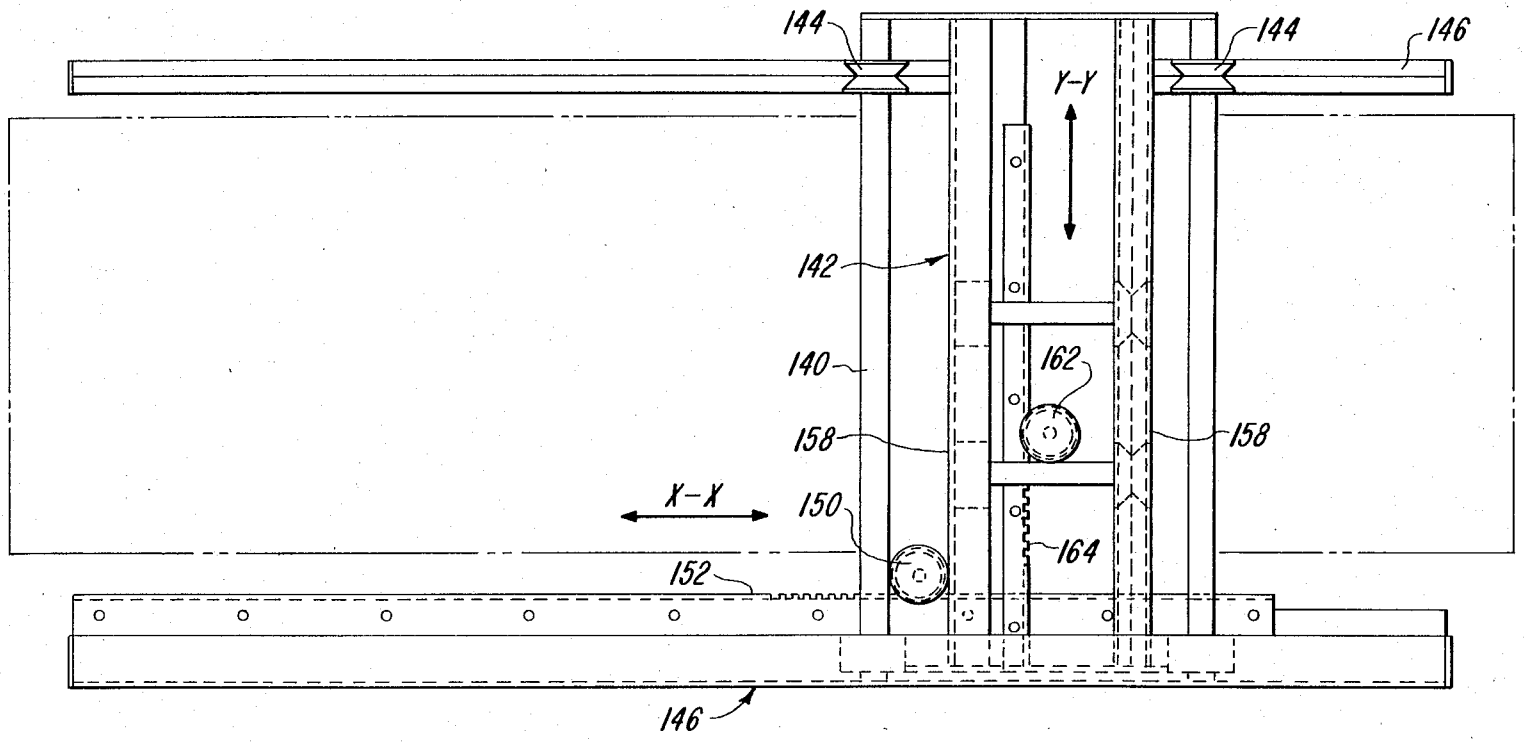
FIG. 17 is a top plan view of one of the sloping tracks of the set-back assembly with the cup removed.

The set-back or transport assembly 50 is shown in detail in FIGS. 16, 17 and 18, as well as being schematically illustrated in FIGS. 2A–2C through 7A–7C. As shown in FIGS. 16 and 17, the set-back assembly 50 includes a lower carriage 140 and an upper carriage 142. The lower carriage 140 is mounted on a first set of wheels 144 which ride on a first set of tracks 146 in a first or X-direction. The X-direction is illustrated in FIG. 17 and, as noted, the lower carriage 140 is movable along two opposite and aligned paths in the X-direction. For purposes of this discussion, a movement in a forward X-direction is defined as movement of the set-back assembly 50 in the X-direction towards the lower arm assembly 48, as positioned in FIGS. 2C through 7C. A movement in a rearward X-direction is defined as movement of the set-back assembly 50 in the X-direction away from the lower arm assembly 48, as positioned in FIGS. 2C through 7C. For example, with respect to FIG. 2C, coupled pipe stand 32 from or delivers an uncoupled pipe stand 32 to the lower arm assembly 48.

A servomotor drive 148 coupled to a gear 150, which engages a rack 152 of the first set of tracks 146, is used to drive the lower carriage 140 in the X-direction. The upper carriage 142 is a generally inverted V-shaped structure having sloping legs 154. The upper carriage 142 is mounted on a second set of wheels 156 which ride on a second set of tracks 158. The second set of tracks 158 is mounted on the lower carriage 140. A servomotor drive 160 coupled to a gear 162, which engages a rack 164 of the second set of tracks 158, is used to move the upper carriage 142 in a second or Y-direction. This Y-direction is at right angles to the movement of the lower carriage 140 so that the setback assembly 50 has complete movement in a horizontal plane. For purposes of this discussion, a movement in a forward Y-direction is defined as the movement of the set-back assembly 50 in the Y-direction towards the lower arm assembly 48, as positioned in FIGS. 2C through 7C. A movement in a rearward Y-direction is defined as a movement of the set-back assembly 50 in the Y-direction away from the lower arm assembly 48, as positioned in FIGS. 2C through 7C. For example, with respect of FIG. 2C, the set-back assembly 50 was moved in a rearward Y-direction from its standby position.

The X-direction and Y-direction can also be defined with respect to a rotary table used to rotate the drill string. The X-direction is a direction tangential to the rotary table and the Y-direction is a direction perpendicular to the rotary table.

Overlying each leg 154 of the upper carriage 142 is an inclined or sloping track 166, as seen in FIG. 18. Plates 168 are mounted to move along each track 166 using screw members 170 rotated by servomotor drives 172 through reduction gears 174. A bracket 176 is mounted on each plate 168. Each bracket 176 carries an open-sided cup or receptacle 178. As illustrated in FIG. 16, the cups 178 are used to receive the lower tapering portion of a pipe stand 32. The set-back assembly 50 also includes transducers 180 operatively fastened to the cups 178, one of the two identical transducers 180 being represented in FIG. 8. The transducers 180 sense whether a pipe stand 32 is fixedly held in the cup 178. The programmable controller 30 initiates movement of the set-back assembly 50 only after it has received an indication from a transducer 180 that a pipe stand 32 is properly in place. Prior to the set-back assembly 50 receiving a pipe stand 32 from the lower arm assembly 48, the programmable controller 30 also determines whether the set-back assembly 50 is in its standby or reference position. This determination by the programmable controller 30 can be made using a transducer (not shown).

In addition to the newly devised controlled devices previously identified as the upper arm assembly 44, finger board assembly 46, lower arm assembly 48, and set-back assembly 50, the present system also includes controlled and/or monitored devices in which conventional pipe drilling equipment has been uniquely modified for integration into the present invention. In particular, power slips 182, a pipe elevator 184, a power tong 186, a power spinner 188, drawworks 190, and brake 192 of FIG. 1 include newly incorporated hardware to permit controlling and monitoring thereof. In one embodiment, conventional power slips, pipe elevator, power tong and power spinner are available from Varco International, Inc. of Orange, Cal.; conventional drawworks is available from Continental Emsco, a LTV Company of Dallas, Tex.; and a conventional brake is available from Dretech, A Dresco Company of Houston, Tex. Devices which are only monitored and not controlled by the programmable controller 30 and include newly incorporated hardware are a rotary table 194 and rig support systems 196 of FIG. 1.

Figure 19:
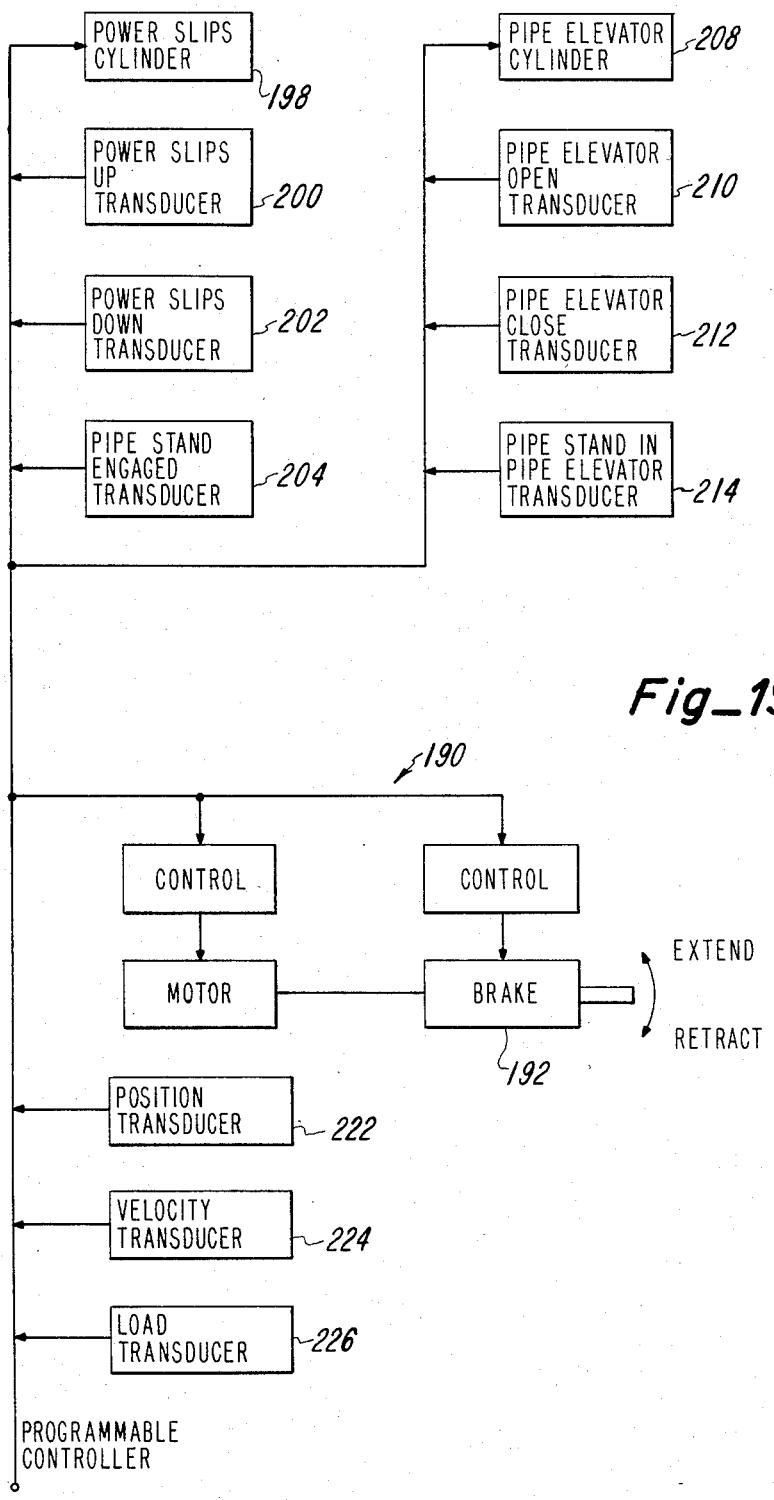
FIG. 19 is a block diagram representing cylinder-piston devices and transducers associated with the power slips, pipe elevator, drawworks, and brake.

The function of each of these controlled and/or monitored devices will now be described. With reference to FIGS. 1, and 19, the programmable controller 30 controls the functioning of the power slips 182. The power slips 182 are positioned at the opening in the drill rig floor 36 and are used to support pipe stands 32 located below the drill rig floor 36 by acting as a wedge between the rotary table 194 on drill rig floor 36 and the pipe stands 32. When a pipe stand 32 is to be coupled or uncoupled from other pipe stands 32, the power slips 182 are activated using the programmable controller 30 to fixedly grasp the top portion of the remaining coupled pipe stands located below the drilling rig floor to support them during the coupling or uncoupling operation.

With reference to the schematic representation provided in FIG. 19 relating to the power slips 182, the programmable controller 30 controls a conventional penumatic powered cylinder-piston device 198 which is operatively connected to the power slips 182 for use in causing movement of the power slips 182 towards or away from the top portion of the remaining pipe stands 32. This movement of the power slips 182 is sensed by transducers 200, 202. The outputs of the transducers 200, 202, which sense the movement of the power slips 182 towards the pipe stands 32 and away from the pipe stands 32, respectively, are transmitted to the programmable controller 30 so that the system is cognizant of the positioning of the power slips 182. In addition, a transducer 204 is operatively connected to the power slips 182 for sensing whether the power slips 182 have firmly engaged the top portion of the remaining coupled pipe stands 32. Only after this condition of engagement has been sensed and this sensed condition provided to the programmable controller 30 will the coupling or uncoupling operation begin. The cylinder-piston device 198 and transducers 200, 202, 204 are incorporated on conventional power slips for use in creating automated power slips 182.

The programmable controller 30 also controls the functioning of the pipe elevator 184, as depicted in block form of FIG. 1. The pipe elevator 184 is used to engage the top portion of pipe stands 32 which are to be coupled to or uncoupled from the remaining coupled pipe stands 32 located below the drill rig floor 36. This engagement of a pipe stand 32 by the pipe elevator 184 is represented schematically in FIGS. 2A, 3A and 4A. The pipe elevator 184 acts like a mechanical hand. The opening and closing of this hand is regulated by the programmable controller 30 which controls a pneumatically powered cylinder-piston device 208, which is represented schematically in FIG. 19. To monitor the operation of the pipe elevator 184, three transducers 210, 212, 214 are utilized. Transducer 210 senses whether the pipe elevator 184 is being opened while transducer 212 senses whether the pipe elevator 184 is being closed. Transducer 214 senses whether a pipe stand 32 is firmly grasped by the pipe elevator 184. Each of the outputs of the transducers 210, 212, 214 is inputted to the programmable controller 30. The pipe elevator 184 is moved vertically with a pipe stand 32 only after transducer 214 indicates to the programmable controller 30 that the upper end of a pipe stand 32 is firmly engaged by the pipe elevator 184. Transducers 210, 212, 214 are incorporated on a conventional pipe elevator for use in creating an automated pipe elevator 184.

The vertical movement of the pipe elevator 184 results from the operation of a drawworks 190 and a brake 192, both of which are represented in block form in FIG. 1. The drawworks 192 is basically a hoisting system which provides the power and hardware for use in raising and lowering pipe stands 32. The drawworks 190 includes a winch (not shown) and cable 218, as depicted in FIGS. 2A through 7A. The cable 218 is connected to a block and hook 220. The block and hook 220 is attached to the pipe elevator 184. The brake 192 is connected to the winch of the drawworks 190. The brake 192 acts to control the amount of weight or load acting on a drill bit attached to the drill column and also controls where the drill bit will stop when the drill column is moved vertically in the well. The brake 192 assists in supporting the weight of the drill column in order to control the positioning of the drill bit in the well so that drilling will take place along a desired path.

In conjunction with drawworks 190 and brake 192 transducers 222, 224, 226 are provided for sensing desired parameters associated with the movement of the drill column and drill bit. This sensed information is transmitted to the programmable controller 30. A schematic representation of portions of the conventional drawworks 190 and brake 192, together with the transducer modifications communicating therewith, is provided in FIG. 19.

Transducer 222 senses the position of the drill column in the well. Transducer 224 provides an indication of the velocity of the drill column in the well when it is moved in a vertical or up/down direction. Transducer 226 senses the load or weight of the drill column on the drill bit. Using this information and appropriate software, the programmable controller 30 is able to determine whether positional changes of the drill column in the well should be made, based, e.g., on a comparison with predetermined or desired positions, velocities, and loads. A conventional drawworks and brake can be modified with transducers 222, 224, 226 for use in providing an automated draw works 190 and brake 192

The programmable controller 30 also controls the functioning of the power tong 186. The power tong 186 includes a number of cylinder-piston devices 230, 232, 234, 236, 238, 240, 242, 244, 246, as represented schematically in FIG. 20. The cylinder-piston devices 230–246 are hydraulically powered and the function of each is set forth in the schematic representations of FIG. 20. The functions of a conventional power tong are well-known in the art. Each cylinder-piston device 230–246 is modified in that a retracted transducer (RT) and an extended transducer (ET) is operatively joined thereto. The present system has incorporated the extended and retracted transducers, together with transducers 245, 247, 249, with a conventional power tong to create the automated power tong 186. The power tong 186 is used to engage a pair of pipe stands 32 adjacent to their coupling joint for use in initially breaking the strong coupling forces provided by the threaded engagement of the two adjacent pipe stands 32 or, alternatively, to provide sufficient torque at the junction of the pipe stands 32 together. The programmable controller 30 controls this operation including movement of the power tong 186 to engage the adjacent pipe stands 32 and then break the coupling therebetween. In conjunction with the functioning of the power tong 186, the transducer 245 informs the programmable controller 30 whether the power tong 186 is properly vertically positioned to engage a pipe stand at its junction or joint with another pipe stand 32. The transducer 247 provides an indication to the programmble controller 30 as to whether a pipe stand 32 has been securely clamped by the power tong 186 before initiating the uncoupling operation. The transducer 249 provides an indication to the programmable controller 30 that torque is applied by the power tong 186 to the pipe stand 32 for the purpose of breaking the coupling between joined pipe stands 32 or securing the coupling between joined pipe stands 32.

After the power tong 186 has initially broken the coupling between adjacent pipe stands 32, the power spinner 188 is utilized to complete the uncoupling of the two pipe stands 32. The power spinner 188 includes, a cylinder-piston device 250, represented schematically in FIG. 20, and which is hydraulically operated for use in opening or closing a spinner clamp of the power spinner 188. The spinner clamp, upon closing, is used to engage and hold a pipe stand 32 adjacent to the coupling junction, as illustrated schematically in FIG. 5A. A transducer 251 is operatively connected to the conventional power spinner 188 in order to provide an indication to the programmable controller 30 as to whether the spinner clamp has engaged the pipe stand 32 to permit complete uncoupling or coupling of a pipe stand 32.

Figure 20:
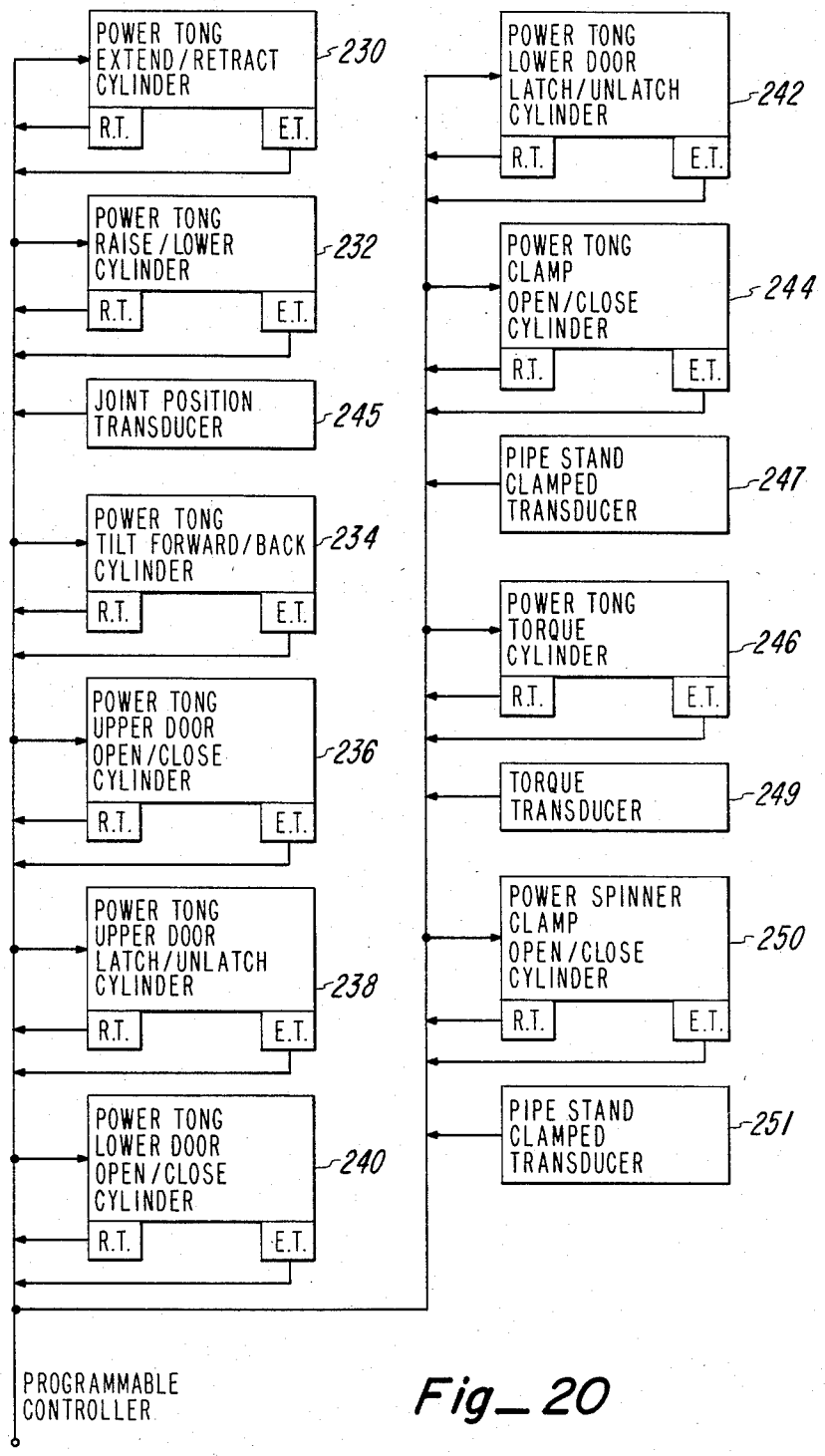
FIG. 20 is a block diagram representing cylinder-piston devices and transducers associated with the power torque/power spinning unit.

After the spinner clamp has engaged the pipe stand 32 adjacent to the coupling junction, a hydraulically powered spinner motor 252, schematically illustrated in FIG. 20, of the power spinner 188 is activated, using the programmable controller 30, for use in threadedly coupling or uncoupling the adjacent pipe stands 32, depending upon whether a pipe stand 32 is being added or removed.

In the case of uncoupling adjacent pipe stands 32, the monitoring of whether these pipe stands 32 are completely disconnected is provided by transducer 254 (pin out). In one embodiment, transducer 254 senses whether any "gap" is present between adjacent pipe stands 32. If a gap is present, a signal is provided by the transducer 254 to the programmable controller 30 indication that the adjacent pipe stands 32 are no longer connected. In a similar manner, a transducer 256 (pin in) informs the programmable controller 30 when the spinner motor 252 has completed its task during the coupling operation and the power tong 186 can then be used to provide the necessary torque to secure the coupling.

In addition to controlling as well as monitoring the aforementioned devices, the programmable controller 30 also monitors equipment commonly provided in a drilling operation. As represented in FIG. 1, the programmable controller 30 monitors the functioning of a rotary table 194. During drilling, the rotary table 194 is operatively connected to the drill string or drill column. The rotary table 194 is powered to rotate in a horizontal plane by a motor located below the drill rig floor 36 and this rotational movement is transferred to the drill column in order to rotate the drill bit. The rotary table 194 is monitored to determine whether it is activated and moving. For example, if the rotary table 194 is activated, the operation for removing or adding pipe stands 32 is inhibited to enhance safety.

The programmable controller 30 also monitors various other drilling conditions, identified in the block diagram of FIG. 1 as rig support systems 196. Since the present invention is intended to be complete controlling and monitoring system in conjunction with the safe removal and addition of pipe stands 32, such conditions as the magnitudes of hydraulic and pneumatic pressures, the operating states of mud pumps, and the presence of poisonous gases in the vicinity of the drilling operation are monitored. In addition to these conditions, it is understood that many other drilling related conditions or parameters can be monitored and an indication thereof be provided using the programmable controller 30 and appropriate software utilized therewith. Typically, the specifications or wishes of each individual drilling user can be accommodated to provide the desired monitoring function.

Another newly-devised device of the present invention, which is represented in the block form of FIG. 1, is an intrusion safety system 258. This system is utilized to maximize safety during the removal and addition of pipe stands 32. The intrusion safety system 258 is both monitored and controlled by the programmable controller 30. The intrusion safety system 258 includes, for example, a number of sensing devices for determining whether a drill rig operator or workman is located within a defined area, including, for example, the area occupied by the upper arm assembly 44, finger board assembly 46, lower arm assembly 48, set-back assembly 50, power slips 182, pipe elevator 184, power tong 186, and power spinner 188. If a drill rig operator is situated in such an area, the programmable controller 30 is programmed to automatically terminate system operation to minimize possible human injury in the defined area.

OPERATION

The operation of the present invention is now described with reference in particular to FIGS. 2A–2C through 7A–7C, which schematically illustrate the removal of a pipe stand 32 from the drill column. The sequence of steps involved in removing pipe stands 32 is known in the drilling industry as "tripping out". In a typical case, tripping out of pipe stands 32 is necessary to replace a worn drill bit. Consequently, a number of pipe stands 32 must be uncoupled and stacked or stored so that the drill bit can be raised from the well and replaced.

Figure 2A:
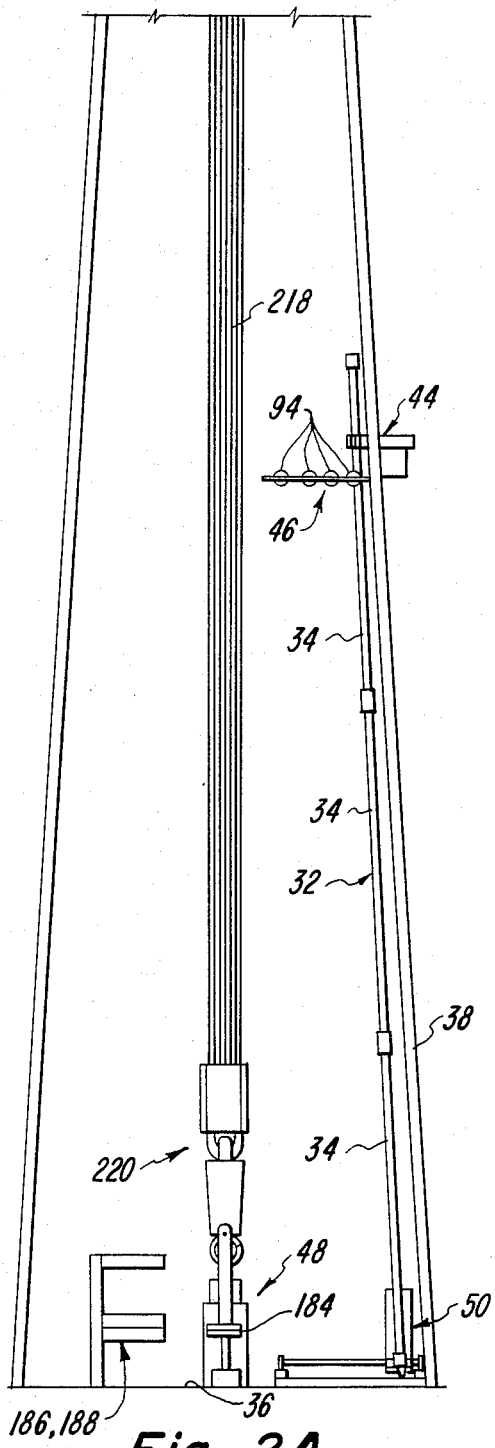
FIGS. 2A–2C are schematic representations showing the pipe elevator grasping a pipe stand.

Before initiating the actual tripping out operation, some preparatory work is done. Specifically, a Kelly or square piece of tubing and a bushing joined to the upper end of the uppermost pipe stand 32, extending upwardly from the drill rig floor 36, are disconnected from this uppermost pipe stand 32 end, raised a short distance using the pipe elevator 184, and are then stored in a location commonly known as a rathole. After the Kelly and bushing are stored, they are disconnected from the pipe elevator 184. The drawworks 190 is activated so that the cable 218 and pipe elevator 184 are lowered to engage the upper portion of the pipe stand 32 which is extending out of the drill rig floor 36. The pipe elevator 184 firmly grasps the upper portion of the pipe stand 32, as illustrated in FIG 2A. When the transducer 214 senses that the pipe stand 32 is fixedly held by the pipe elevator 184, the drawworks 190 is activated to raise the pipe stand 32 to a predetermined height.

It is significant to note that the programmable controller 30 is programmed to verify the proper occurrence of each of the sequence of steps taken in coupling or uncoupling pipe stands 32, using the various transducers and servomotor drives. Before any further action is permitted or the next step is taken, this verification is made. By way of example, the output of transducer 214 is sent to the programmable controller 30 to provide an indication as to whether the pipe stand 32 is held by the pipe elevator 184. If an indication is not provided verifying that the pipe stand 32 was engaged, the next step is not carried out.

In a typical case, a pipe stand 32 may include three pipe sections 34, each pipe section 34 being about thirty feet in length. Inputted to the programmable controller 30 is the length of each pipe section 34. Consequently, it is aware of the length of each pipe section 34 and is able to determine the position of the pipe section sends bases on the vertical movement of the cable 218 to which each pipe stand 32 is attached. The amount of vertical movement of each pipe stand 32 is determined using a transducer (not shown) which monitors the length of cable 218 wound around the winch of the drawworks 190. When the amount of cable 218 wound around the winch of the drawworks 190 corresponds to the known length of the pipe stand 32, the movement of the cable 218 is halted since the pipe stand 32 is now position at a predetermined height in the derrick 38. After the pipe stand 32 is at the desired position, the power slips 182 are activated by the programmable controller 30 so that they will engage and support the pipe stands 32 beneath the drill rig floor 36. The transducer 204 provides a signal to the programmable controller 30 to indicate that the power slips 182 have properly engaged the pipe stands 32.

During the raising of the pipe stand 32, the upper arm assembly 44 is also activated and begins to extend 110 so that it is lowered to disengage the jaw slips 132 from the pipe stand 32, the jaws 134 are opened, and the lower arm 110 is then pivoted and retracted to its position for engaging another pipe stand 32.

The upper arm assembly 44 and the set-back assembly 50 now cooperate to maintain the removed pipe stand 32 in a substantially vertical attitude as it is moved on upper carriage 142 in a rearward Y-direction on the tracks 158. The amount of movement in the Y-direction depends upon where the removed pipe stand 32 is to be stored on the drill rig floor 36. With respect to the illustrations provided in FIGS. 2 and 3, this removed pipe stand 32 is to be stored in substantially the lowermost right hand corner of the stored area. As a consequence, the upper carriage 142 is moved along the set of tracks 158 in a rearward Y-direction to the ends of the set of tracks 158. Simultaneously, the upper arm assembly 44 is retracted so that the upper end portion of the pipe stand 32 remains in substantially vertical alignment with the lower end portion of the pipe stand 32.

When the removed pipe stand 32 is positioned at the desired location in a Y-direction, the programmable controller 30 activates the servomotor drive 68. The servomotor drive 68 causes the wrist 64 to pivot in the programmed direction which is, in the present example, towards the finger board section 86. The degree of pivotal movement is predetermined such that the pipe stand 32 is now positioned adjacent to the end of the selected screw conveyor 94 which is to receive the uncoupled pipe stand 32. At the completion of the predetermined pivoting of the wrist 64, the servomotor 68 remains activated to now cause the extendable wrist portion 67 to extend parallel and adjacent to the selected screw conveyor 94. At the same time the extendable wrist portion 67 is being extended, the selected screw conveyor 94 is making one-half turn. At the completion of the predetermined extension of the extendable wrist portion 67 and the one-half turn of the selected screw conveyor 94, the servomotor 74 is activated to open the jaw 72 and to release the pipe stand 32 to the available helicoidal surface 95. Upon releasing the pipe stand 32 to be held in the helicoidal surface 95, the servomotor 68 is once again activated to retract the extendable wrist portion 67. At the completion of the predetermined retraction of the extendable wrist portion 67, the wrist 64 pivots to its previous position so that the upper arm 52 can again be extended to engage the next pipe stand 32 to be coupled.

Figure 2B:
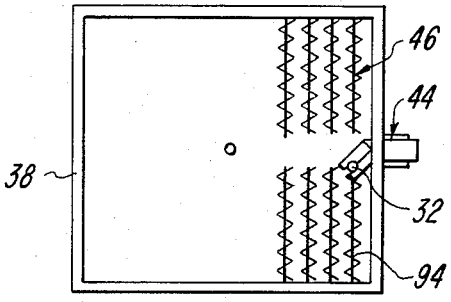
Figure 2C:
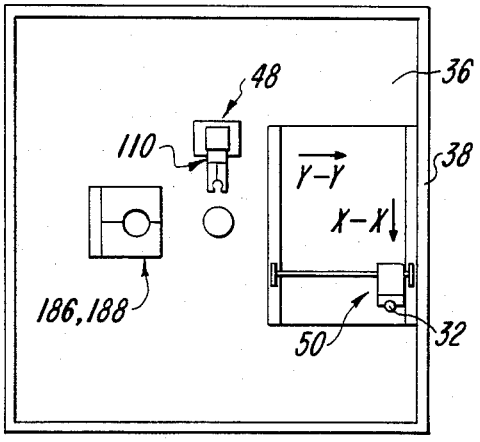

Referring to the schematic representations of FIGS. 2A–2C, while the upper arm assembly 44 is returned to its standby position, the set-back assembly 50 is moved in the rearward X-direction so that the lower portion of the removed pipe stand 32 can be placed in the lowermost right hand corner or position of the storage area. At this position, the bracket 176 and cup 178 holding the lower portion of the pipe stand 32 are moved downwardly along the sloping track 166 of the upper carriage 142. When the cup 178 is positioned at the lower end of the sloping track 166, its open side can separate laterally from the lower end of the pipe stand 32. This allows the set-back assembly 50 to be moved in the forward X-direction so that the lower portion of the pipe stand 32 is removed therefrom and is supported on the drill rig floor 36.

Figure 3A:
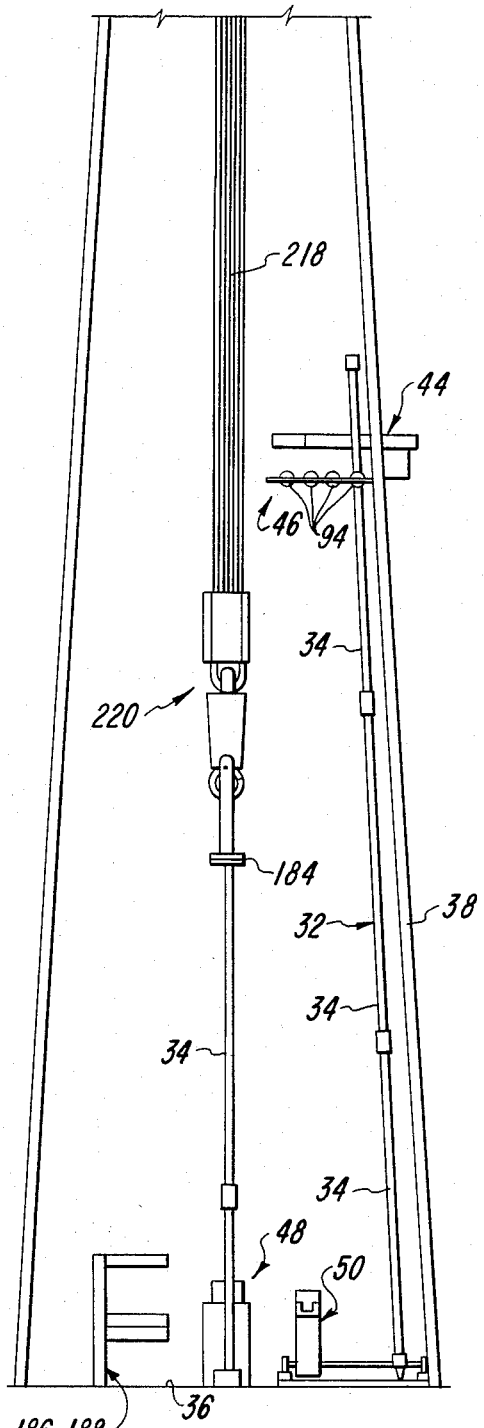
FIGS. 3A–3C are schematic representations showing the pipe elevator raising the grasped pipe stand.
Figure 3B:
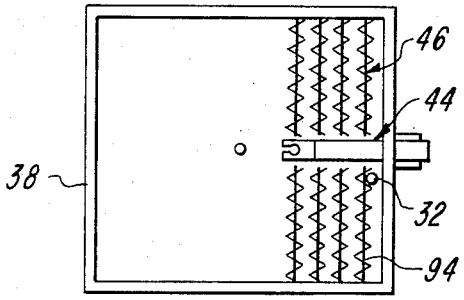
Figure 3C:
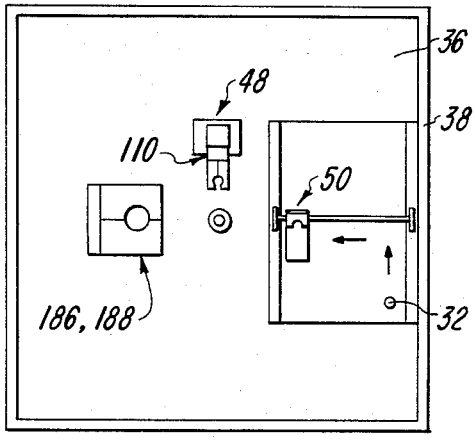
Figure 4A:
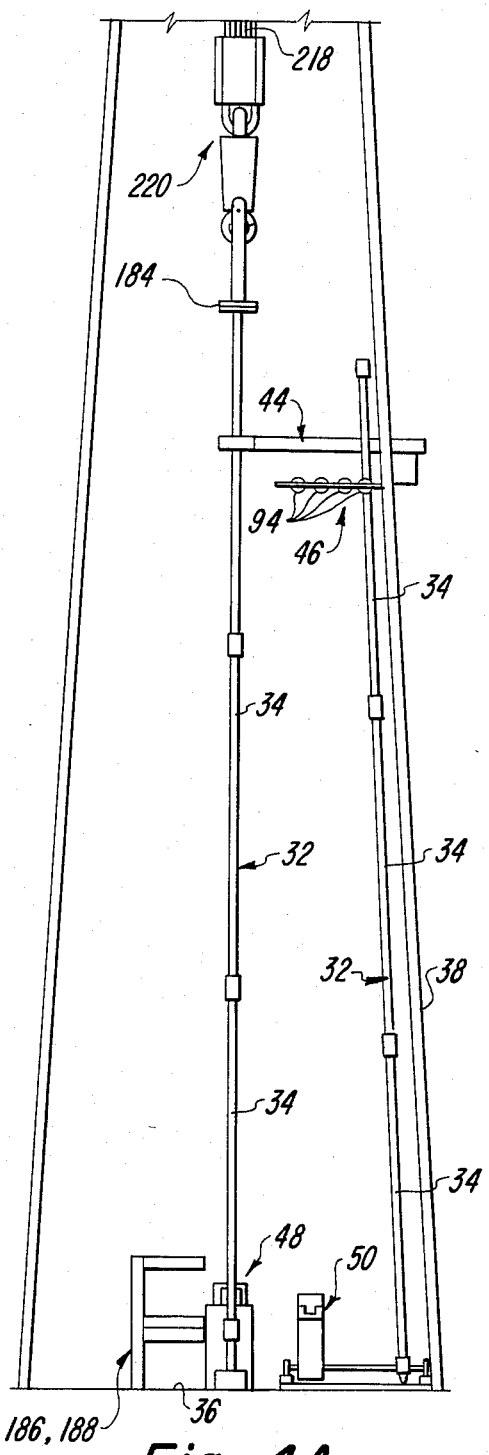
FIGS. 4A–4C are schematic representations showing the upper arm assembly grasping a top portion of the grasped pipe stand.
Figure 4B:
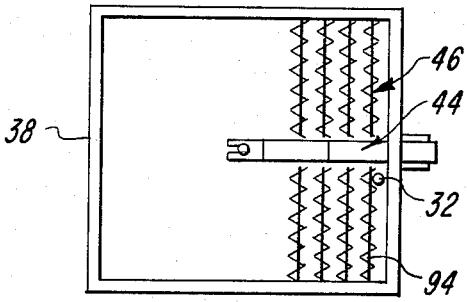
Figure 4C:
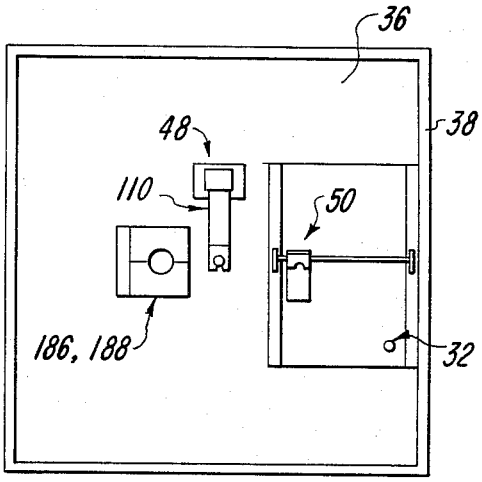
Figure 5A:
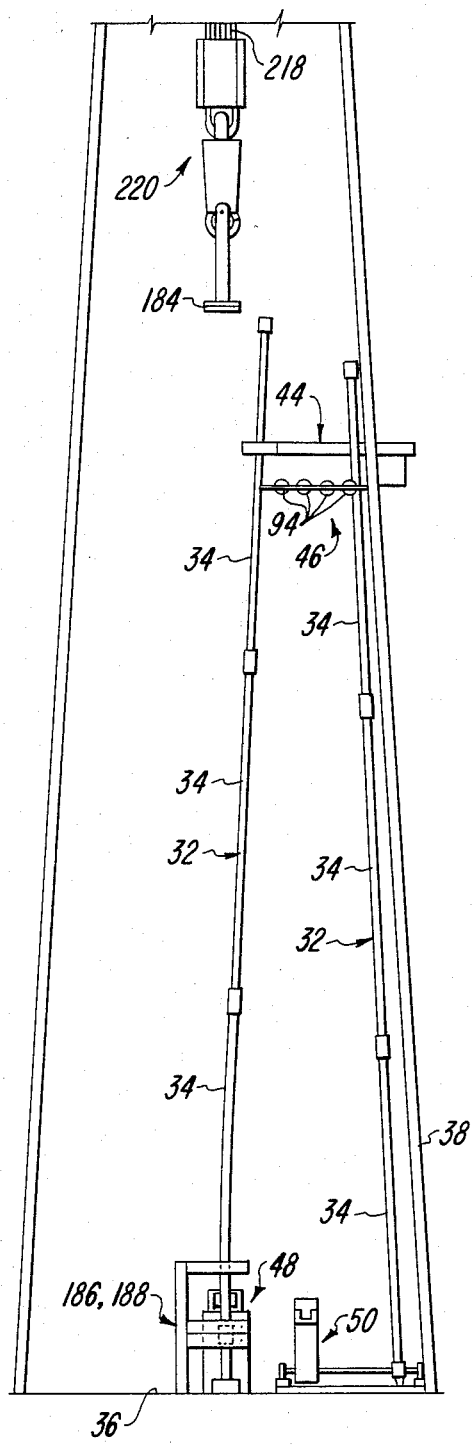
FIGS. 5A–5C are schematic representations showing the upper arm assembly retracting with the grasped pipe stand while the lower arm assembly grasps a bottom portion of the pipe stand.
Figure 5B:
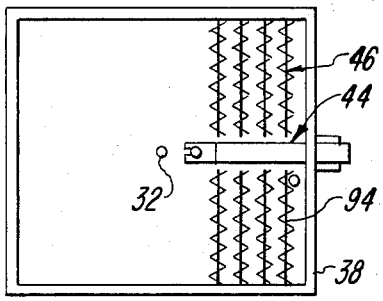
Figure 5C:
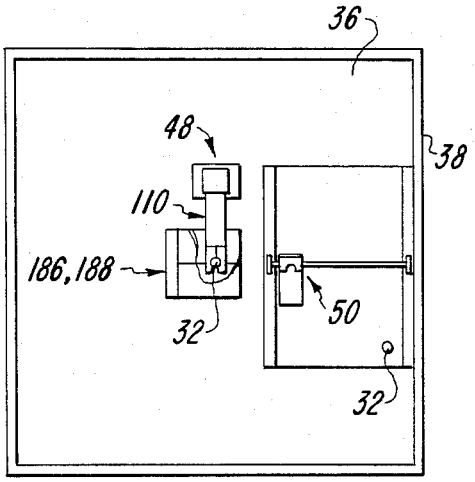
Figure 6A:
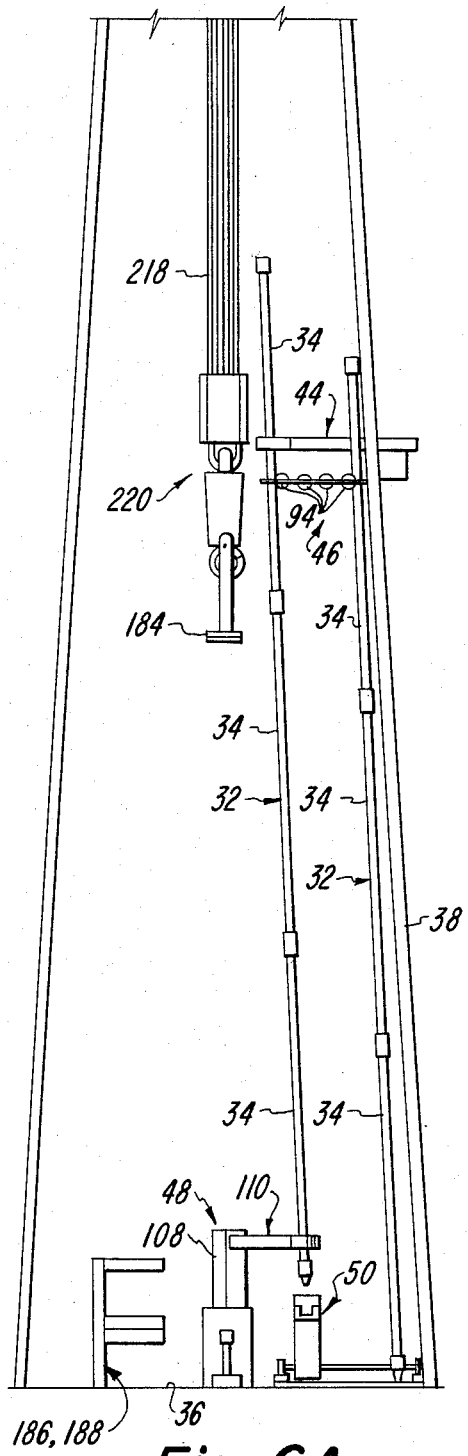
FIGS. 6A–6C are schematic representations showing vertical and horizontal movements of the lower arm assembly.
Figure 6B:
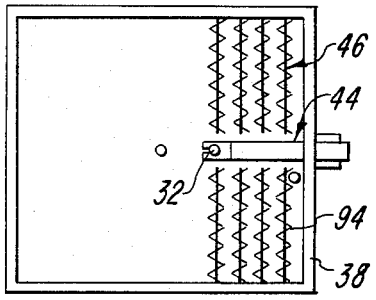
Figure 6C:
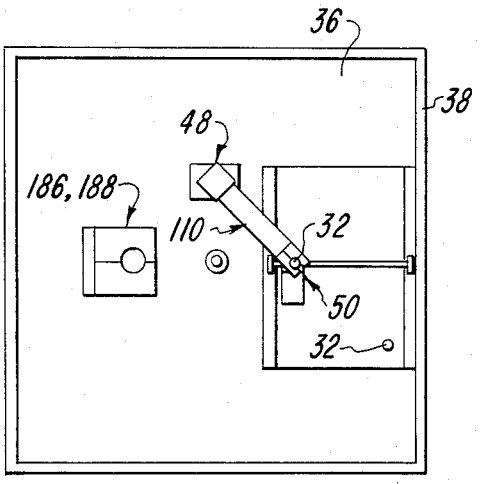
Figure 7A:
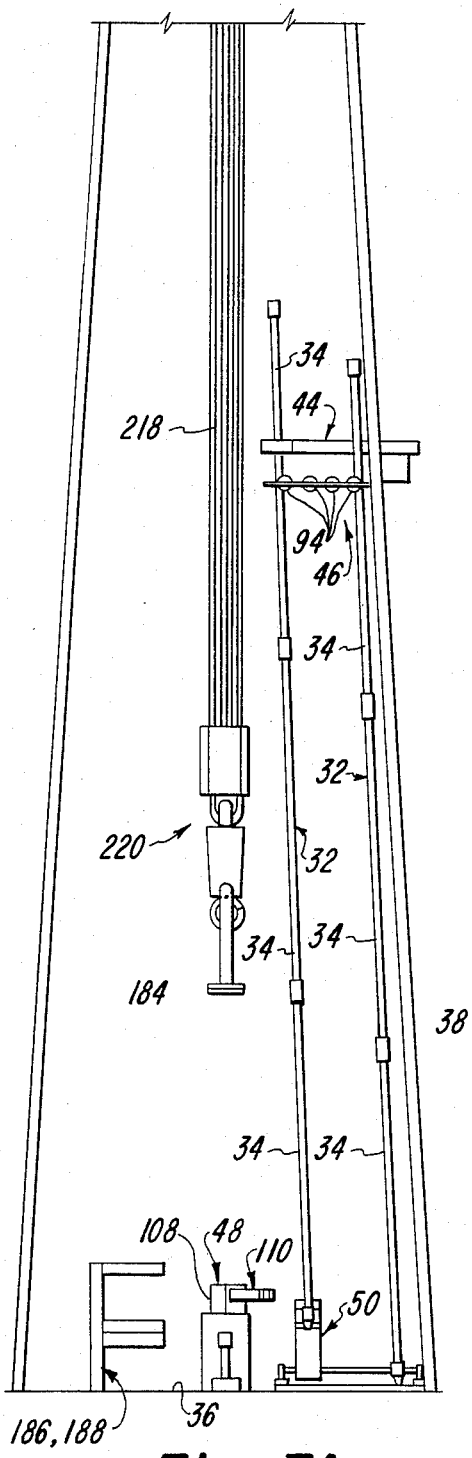
FIGS. 7A–7C are schematic representations showing the pipe stand being received by the set-back assembly.
Figure 7B:
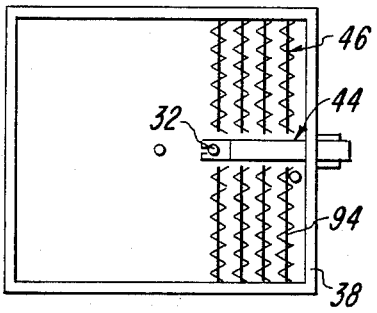
Figure 7C:
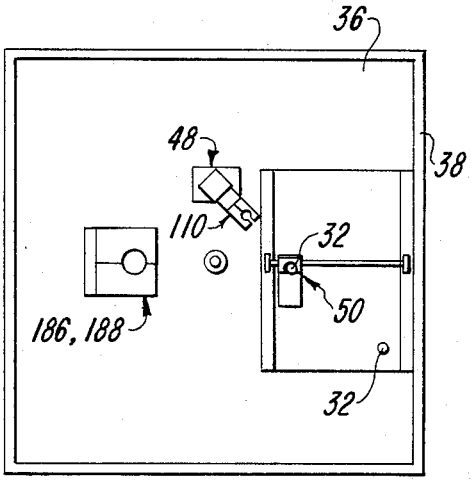

During the time that the set-back assembly 50 is moving the lower end portion of the pipe stand 32, the pipe elevator 184 is once again lowered to receive the next pipe stand 32 to be uncoupled. Upon releasing the first removed pipe stand 32, the set-back assembly 50 is moved to its standby or reference position, as seen in FIG 3C, receiving the next-to-be removed pipe stand 32.

The foregoing process is continued with upper portions of the removed pipe stands 32 being successively placed into the selected screw conveyor 94 and a half-turn of the screw conveyor 94 being made with delivery of each removed pipe stand 32 thereto by the extendable wrist portion 67. The lower portions of the pipe stands 32 are moved to their predetermined positions on the surface of the drill rig floor 36. When a screw conveyor 94 becomes completely filled with removed pipe stands 32, each upper portion of each stored pipe stand 32 will once again be in vertical alignment with its lower portions since the screw conveyor 94 moves all upper portions of pipe stands 32 one-half turn each time one additional pipe stand 32 is received by the screw conveyor 94. Consequently, at the time the selected screw conveyor 94 has rotated to position a pipe stand 32 in an open helicoidal surface located at the end of the screw conveyor 94 opposite that end adjacent to the upper arm assembly 44, that pipe stand 32 is substantially vertical.

If all available helicoidal surfaces 95 of all screw conveyors 94 of the first finger board section 86 should be filled with removed pipe stands, the set-back assembly 50 is used to carry additionally removed pipe stands 32 in a forward X-direction opposite that of the rearward X-direction. Specifically, the other of the two cups 178 is now selected to receive the lower portion of the removed pipe stand 32 and the wrist 64 of the upper arm assembly 44 pivots in the opposite direction to place the removed pipe stand 32 into a screw conveyor 94 of the second finger board section 88. In such a manner, both finger board sections 86, 88, together with the underlying drill rig floor 36, can be filled in a predetermined manner with removed pipe stands 32.

In moving the set-back assembly 50 to the predetermined position for releasing of the lower portion of the pipe stand 32, the programmable controller activates servomotor drives 148, 160. These two servomotor drives 148, 160 also provide the active feedback to the programmable controller 30 to enable it to determine whether the set-back assembly 50 is at the desired position. When each predetermined X,Y position is reached by the set-back assembly 50, the programmable controller 30 deactivates the appropriate servomotor drive 148, 160. As with previously discussed movement controls in the present system, appropriate software can be devised to properly position all controlled devices, including the set-back assembly 50.

With respect to coupling or adding pipe stands to the remaining pipe stands 32, generally known in the field as "tripping in", the foregoing process is essentially reversed. In this regard, typically, the last screw conveyor 94 accessed to receive a removed pipe stand 32 is the first to be activated in order to place the upper portion of the pipe stand 32 in a position to be received by the jaws 72 of the upper arm assembly 44. The set-back assembly 50 is also positioned to receive this last-to-be-removed pipe stand 32. After the upper arm assembly 44 and set-back assembly 50 have moved the pipe stand 32 so that the set-back assembly 50 is in its standby position, the lower arm assembly 48 can be activated to engage the lower portion of the pipe stand 32 and move it into alignment with any remaining pipe stand 32 extending below the drill rig floor. The power tong 186 and power spinner 188 are utilized to couple together the adjacent pipe stands 32 while the upper portion of the to-be-coupled pipe stand 32 is moved using the upper arm assembly 44 to align it with the pipe elevator 184. The pipe elevator 184 engages the upper portion of the to-be-coupled pipe stand 32 and, after the coupling is completed at the lower portion thereof, the pipe elevator 184 is lowered by the drawworks 190 so that the newly added pipe stand 32 is lowered below the drill rig floor 36. In such a manner, additional pipe stands 32 can be removed from storage and coupled to the remaining pipe stands 32 for placememnt below the drill rig floor 36.

It is also understood that various other particular sequences of accessing the screw conveyors 94 can be provided using software. For example, in order to possibly better equalize the use and wear of each of the pipe stands 32, a sequence of pipe stand 32 selection can be devised which will provide this desired result, such as the last pipe stand 32 uncoupled from the drill string is not the first pipe stand 32 to be recoupled to the drill string.

During the uncoupling and coupling of pipe stands 32, the programmable controller 30 is also continuously monitoring drilling-related equipment, such as the rotary table 194 and rig support systems 196. If a predetermined fault condition should be received by the programmable controller 30, the software takes immediate ate and appropriate action, e.g., shutting down or terminating the system operation. As discussed previously, in addition to monitoring these pieces of equipment, the programmable controller 30 also monitors the operation of the controlled devices, such as the upper arm assembly 44, finger board assembly 46, lower arm assembly 48, set-back assembly 50, power slip 182, pipe elevator 184, power tong 186, power spinner 188, drawworks 190, brake 192, and intrusion safety system 258. If a predetermined fault condition should occur relating to any one of these controlled devices, or if one or more of these devices should fail to function properly, the software instructed programmable controller 30 takes immediate and appropriate action.

In addition to the automatic control provided by the present invention, the present system also provides for semi-automatic operation so that an operator or workman has the capability to override the fully automated system and directly control the functioning of the hardware equipment. In particular, the upper arm assembly 44, finger board assembly 46, lower arm assembly 48, and set-back assembly 50 can be separately controlled. Also, the power slips 182, pipe elevator 184, power tong 186, and power spinner 188 can also be separately controlled thereby overriding the complete automatic control provided by the programmable controller 30.

Means are also provided whereby each of the upper arm assembly 44, finger board assembly 46, lower arm assembly 48, set-back assembly 50, and other controlled or sensed devices can be disabled in one or more different combinations. Thus, if a disabling fault should occur in one of the controlled or sensed devices, the remaining devices can be selectively utilized by means of the programmable controller 30 in non-automated sequences to enable continued operation in a "semiautomated" mode.

Additionally, means are provided, in case of faults, so that portion of the system of the present invention can be operated manually, i.e., mechanically by hand, such as lever and ratchet mechanisms (not shown), in order to provide the capability to continue with operation of the system.

Based on the foregoing detailed description, a number of worthwhile features of the present invention are discerned. An automated pipe handling system including verification means is provided which significantly minimizes the number of workmen required to accomplish the tripping out and tripping in functions associated with drilling. Concomitantly, the safety of workmen is greatly enhanced since they need not be directly involved in the coupling and uncoupling operation. Moreover, pertinent parameters and conditions relating to the drilling operation are monitored so that fault conditions can be indicated to advise the workmen of the existence of any such fault conditions and further minimize possible human injury. The present system provides for intervention by an operator when required and is intended to utilize, as far as possible, conventional drilling equipment to reduce the cost of automation. In addition, the present invention maximizes repeatability of operation, reduces operational and maintenance costs, and increases the capability of faster handling and moving of pipe.

Although the present invention has been described with reference to specific embodiments thereof, it is readily understood that further variations and modifications can be effected within the spirit and scope of this invention.

What is claimed is:

1. An automated system for use in facilitating the coupling or uncoupling of pipe, comprising:

first means for moving a pipe between a storage position and a coupling position, said first means including transport means for receiving a lower portion of the pipe and being movable to place the lower portion of the pipe in a predetermined position, said transport means including:

cup means for receiving at least portion of the pipe, a lower carriage movable in a first direction, an upper carriage supported on said lower carriage and movable in a second direction, and sloping track means supported on said upper carriage for use in moving said cup means therealong in upwardly and downwardly directions; second means for use in coupling or uncoupling pipe;

transducer means operatively associated with said first means and said second means for sensing whether said first means has gripped the pipe and also sensing whether said second means has gripped the pipe; and control means in operative association with said first means, said second means, and said transducer means for automatically controlling said first means and moving uncoupled pipe to a predetermined storage position, said control means responding to said transducer means in conjunction with the controlling of movement of the pipe using said first means.

2. A system, as claimed in claim 1, wherein said first means includes:

extendable upper arm means for engaging an upper portion of the pipe; and lower arm means for engaging a lower portion of the pipe.

3. A system, as claimed in claim 1, wherein said first means includes:

a finger board assembly including means for holding and moving the pipe received by said finger board assembly.

4. A system, as claimed in claim 1, wherein said second means includes:

power slip means having an engaged position and a disengaged position relative to pipe, said power slip means being controlled by said control means for engaging or disengaging pipe.

5. A system, as claimed in claim 2, wherein said transducer means includes:

a first transducer connected to said upper arm means and in communication with said control means to provide an input to said control means as to whether the pipe is gripped; and a second transducer connected to said lower arm means and in communication with said control means to provide an input to said control means as to whether the pipe is gripped.

6. A system, as claimed in claim 2, wherein said upper arm means includes:

a main body;

at least one extendable portion operatively attached to said main body;

means operatively connected to said extendable portion for use in moving said extendable portion relative to said main body;

a pivotal and extendable wrist attached to said extendable portion; and a pair of jaws connected to said wrist.

7. A system, as claimed in claim 2, wherein said lower arm means includes:

a lower arm rotatable in a horizontal plane and movable in an upward direction.

8. A system, as claimed in claim 3, wherein said finger board assembly includes:

at least one rotatable conveyor for receiving a plurality of pipes.

9. A system, as claimed in claim 8, wherein:

said rotatable conveyor includes a helicoidal surface for use in holding a plurality of pipes.

10. A system, as claimed in claim 8, wherein said finger board assembly includes:

means controllable by said control means for operatively connecting power to said rotatable conveyor.

11. A system, as claimed in claim 1, wherein said control means includes:

feedback means for use in determining a position of at least a portion of said first means.

* * * * *